US012433332B2

(12) United States Patent
Xie

(10) Patent No.: US 12,433,332 B2
(45) Date of Patent: Oct. 7, 2025

(54) HEAT-NOT-BURN CARTRIDGE WITH TOBACCO PAPER

(71) Applicant: CENTRAL VICTORY LIMITED HK, Hong Kong (CN)

(72) Inventor: Haojun Xie, Guangxi (CN)

(73) Assignee: CENTRAL VICTORY LIMITED HK, Hong Kong (CN)

( * ) Notice: Subject to any disclaimer, the term of this patent is extended or adjusted under 35 U.S.C. 154(b) by 494 days.

(21) Appl. No.: 17/640,532

(22) PCT Filed: Sep. 6, 2019

(86) PCT No.: PCT/CN2019/104654

§ 371 (c)(1),
(2) Date: Mar. 4, 2022

(87) PCT Pub. No.: WO2021/042359

PCT Pub. Date: Mar. 11, 2021

(65) Prior Publication Data

US 2022/0330609 A1 Oct. 20, 2022

(51) Int. Cl.

| | |
|---|---|
| ***A24F 40/30*** | (2020.01) |
| ***A24F 7/00*** | (2006.01) |
| ***A24F 40/10*** | (2020.01) |
| ***A24F 40/20*** | (2020.01) |
| ***A24F 40/42*** | (2020.01) |
| ***A24F 40/44*** | (2020.01) |

(Continued)

(52) U.S. Cl.

CPC ..... *A24F 40/30* (2020.01); *A24F 7/00* (2013.01); *A24F 40/10* (2020.01); *A24F 40/20* (2020.01); *A24F 40/42* (2020.01); *A24F 40/44* (2020.01); *A24F 40/46* (2020.01); *A24F 40/51* (2020.01); *A24F 40/60* (2020.01)

(58) Field of Classification Search

None

See application file for complete search history.

(56) References Cited

U.S. PATENT DOCUMENTS 5,479,948 A * 1/1996 Counts ..... A24F 40/42 131/194
6,446,426 B1 * 9/2002 Sweeney ..... A01M 13/00 131/194

(Continued)

FOREIGN PATENT DOCUMENTS

| | | |
|---|---|---|
| CN | 108741233 | 11/2018 |
| WO | 2018/023188 | 2/2018 |

OTHER PUBLICATIONS

International Search Report for PCT/CN2019/104654, mailed Jun. 15, 2020, 4 pages.

(Continued)

*Primary Examiner* — Katherine A Will

(74) *Attorney, Agent, or Firm* — Nixon & Vanderhye P.C.

(57) ABSTRACT

A heat-not-burn tobacco paper cartridge (10) includes a first rotatable support (24) and a second rotatable support (26). The first and second rotatable supports are configured to transfer a strip of tobacco paper (28) from the first rotatable support to the second rotatable support. The cartridge also includes a heater (20) positioned between the first and second rotatable supports. The heater is configured to heat a portion of the strip of tobacco paper extending between the first and second rotatable supports.

41 Claims, 6 Drawing Sheets

(51) Int. Cl.

| | |
|---|---|
| ***A24F 40/46*** | (2020.01) |
| ***A24F 40/51*** | (2020.01) |
| ***A24F 40/60*** | (2020.01) |

(56) References Cited

U.S. PATENT DOCUMENTS

| | | | |
|---|---|---|---|
| 9,854,848 | B1 | 1/2018 | Servutas |
| 2015/0040926 | A1 | 2/2015 | Saydar et al. |
| 2018/0116294 | A1 | 5/2018 | Saydar et al. |
| 2018/0160741 | A1 | 6/2018 | Worm et al. |

OTHER PUBLICATIONS

Written Opinion of the ISA for PCT/CN2019/104654, mailed Jun. 15, 2020, 3 pages.

* cited by examiner

HEAT-NOT-BURN CARTRIDGE WITH TOBACCO PAPER

This application is the U.S. national phase of International Application No. PCT/CN2019/104654 filed Sep. 6, 2019, which designated the U.S. and claims priority to the entire contents of each of which are hereby incorporated by reference.

TECHNICAL FIELD

The invention relates to a heat-not-burn cartridge with tobacco paper.

BACKGROUND

Cigarettes and cigars provide one popular method for using tobacco. However, those devices require that the tobacco and surrounding paper be combusted. Although the absorption of nicotine in the user's lungs is the intended result, there are over four thousand components of cigarette smoke. Four hundred of such components are known carcinogens or harmful toxins.

Furthermore, a substantial number of fires are caused as a result of smoking. Thousands of people are injured or killed, and millions of dollars in property loss occur each year in the United States as a direct result of cigarette smoking. Finally, a few relatively minor problems associated with smoking—stained teeth, dry and wrinkle-prone skin, and smoke-damaged clothing—make the habit annoying as well as dangerous.

It should also be noted that once combusted, the cigarettes and cigars will continue to burn until the cigar or cigarette is used up. However, a user cannot continuously inhale the resulting smoke. Accordingly, a substantial percentage of the tobacco is wasted to uninhaled smoke. Therefore, cigarettes and cigars are very inefficient.

A variety of cigarette-like devices have been invented in an effort to counteract the foregoing negative aspects of smoking. These devices, however, have only provided limited solutions often at the expense of commercial success or consumer acceptance. Complex filters and devices which otherwise improve the quality of the smoke delivered to the smoker do not provide solutions to the bulk of the concerns associated with traditional cigarettes.

BRIEF SUMMARY

The heat-not-burn tobacco paper cartridge described herein attempts to improve the deficiencies of cigarettes and cigars as well as cigarette-like devices.

In a first aspect of the technology, a heat-not-burn tobacco paper cartridge may include a first rotatable support, a second rotatable support. The first and second rotatable supports may be configured to transfer a strip of tobacco paper from the first rotatable support to the second rotatable support. The heat-not-burn tobacco paper cartridge may also include a heater positioned between the first and second rotatable supports. The heater may be configured to heat a portion of the strip of tobacco paper extending between the first rotatable support and the second rotatable support.

The heater may be configured to heat the portion of the strip of tobacco paper without combusting the tobacco paper.

The heater may be configured to vaporize tobacco from the portion of the strip of tobacco paper without combusting the tobacco paper.

The cartridge may further include a casing that encloses the first rotatable support, the second rotatable support, the strip of tobacco paper, and the heater.

The cartridge may further include a driving wheel positioned adjacent the heater. The driving wheel may be configured to pull the tobacco paper across the heater.

The heater may include a guide vane configured to guide the strip of tobacco paper along a path from the first rotatable support to the second rotatable support.

The cartridge may further include a fluid container in which chemically infused liquid is stored.

The fluid container may include a liquid heater configured to vaporize the liquid stored in the fluid container.

The fluid container may be adjacent the tobacco heater.

The heater may be configured to vaporize tobacco from the tobacco paper. In addition, the vaporized tobacco may be configured to mix with the vaporized fluid from the fluid container.

A wick may extend from the fluid container to the heater.

The wick may be configured to draw the liquid from the fluid container to the heater.

The heater may be configured to simultaneously vaporize liquid in the wick and tobacco in the tobacco paper.

The cartridge may further include a mouthpiece.

In another aspect of the technology, a heat-not-burn system may include the cartridge discussed above and a base configured to releasably receive the cartridge.

In yet another aspect of the technology, a heat-not-burn tobacco paper cartridge may include a first rotatable support and a second rotatable support. The first rotatable support may be configured to support a roll of tobacco paper. The second rotatable support may be configured to receive the tobacco paper from the first rotatable support. The cartridge may also include a heater between the first and second rotatable supports. The heater may be configured to vaporize tobacco in an unrolled portion of the tobacco paper between the first rotatable support and the second rotatable support.

The cartridge may include a switch, button, or pressure sensor configured to actuate the heater.

The heater may be configured to actuate by a user inhaling vapor formed in the cartridge.

The cartridge may further include a driving wheel configured to intermittently pull the tobacco paper across a surface of the heater.

The driving wheel may be configured to press the tobacco paper against the surface of the heater.

The driving wheel may be positioned upstream of the heater, and the tobacco paper may be sandwiched between the driving wheel and a follower wheel.

The driving wheel may be positioned downstream of the heater, and the tobacco paper may be sandwiched between the driving wheel and a follower wheel.

The width of the tobacco paper may be less than 3.0 cm.

The length of the tobacco paper may be 100 meters or less.

The cartridge may further include a mouthpiece.

In yet another aspect of the technology, a heat-not-burn system may include the cartridge discussed above and a base configured to releasably receive the cartridge.

In yet another aspect of the technology, a heat-not-burn tobacco paper cartridge may include a first rotatable support, a second rotatable support, and a strip of tobacco paper attached to both the first and second rotatable supports. The cartridge may also include a tobacco heater configured to vaporize tobacco from the tobacco paper without combusting the tobacco or the tobacco paper. The strip of tobacco paper may be configured to be transported through an interior of the tobacco heater in response to user input.

The cartridge may further include a casing that encloses the first rotatable support, the second rotatable support, the tobacco paper, and the tobacco heater.

The casing may include a make-up vent.

The cartridge may further include a first driving wheel and a second driving wheel. Each of the first and second driving wheels may be configured to pull the tobacco paper through the tobacco heater.

The first driving wheel may be located upstream of the tobacco heater, and the second driving wheel may be located downstream of the tobacco heater.

The cartridge may further include a user input source configured to actuate movement of the tobacco paper from the first rotational support to the second rotational support.

The user input source may be a button, a switch, and/or a pressure sensor.

The user input source may be a flow sensor and/or a pressure sensor configured to detect a user's inhalation.

The cartridge may further include a mouthpiece.

In yet another aspect of the technology, a heat-not-burn system may include the cartridge discussed above and a base configured to releasably receive the cartridge.

DETAILED DESCRIPTION

Figure 1:
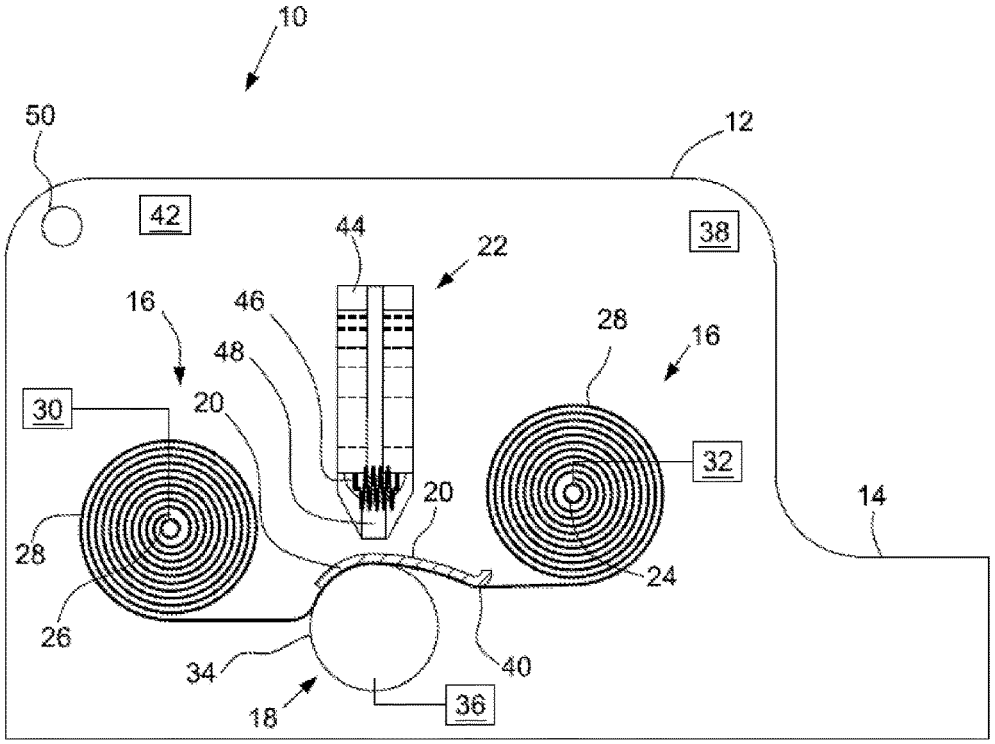
FIG. 1 is a plan view of an exemplary heat-not-burn tobacco paper cartridge.

FIG. 1 shows a heat-not-burn cartridge (or cassette) 10 that generates a tobacco infused aerosol for inhalation by a user. The heat not burn cartridge 10 may be in the form of a self-contained reel-to-reel device and may include a sealed housing 12 with a mouthpiece 14. It is contemplated that the housing 12 may be made of plastic, metal, or any other material that is able to be shaped into a cassette-like form. It is further contemplated that the housing 12 may be opaque, transparent or translucent. The mouthpiece 14 may be formed integrally with the housing 12 or may be a separate component that is attachable to the housing 12. In addition, the mouthpiece 14 may be permanently attached to the housing 12 or may be interchangeable with other mouthpieces 14. The housing 12 may enclose a tobacco paper support assembly 16, a drive assembly 18, a heater 20, and a fluid container 22.

The tobacco paper support assembly 16 may include a rotatable supply support 24 and a rotatable take-up support 26 that operate in tandem to support a strip of tobacco paper 28. The supply and take-up supports 24, 26 may each be a spool, a spindle, reel, or any other rotatable device capable of supporting a winding of tobacco paper. The tobacco paper 28 may be a paper product made out of dried tobacco. For example, dried tobacco may be processed into a concentrated syrup with the remaining fibers being further processed into a pulp. The concentrated syrup may be added back into the pulp. Once the drying process is completed, the final product may be in the form of a paper (i.e., a tobacco paper) that has the same characteristics as unprocessed, dried tobacco. The tobacco paper 28 may be cut into strips, which then may be attached or threaded onto the supply support 24 and the take-up support 26. It is contemplated that the tobacco paper 28 may have a width that is 3.0 cm or less (e.g., between 0.01 cm and 3.0 cm, between 0.01 cm and 2.5 cm, between 0.01 cm and 2.0 cm, etc.) and may have a length that is 100 meters or less (e.g., between 0.01 cm and 100 meters, between 0.01 cm and 50 meters, between 0.01 cm and 25 meters, etc.).

FIG. 1 shows the state of the tobacco paper 28 after a few cycles of use. In particular, the tobacco paper 28 may be wound around both the supply support 24 and the take-up support 26. Prior to initial use, most of the tobacco paper 28 may be wound around the supply support 24 with a minimal amount of the tobacco paper 28 being wound around the take-up support 26. The end of the heat-not-burn cartridge's 10 useful life may occur when at least almost all of the tobacco paper 28 is transferred to the take-up support 26. It is contemplated that the ends of the tobacco paper 28 may be spliced with non-tobacco paper to ensure that all of the tobacco in the tobacco paper 28 is vaporizable.

The take-up support 26 may be driven by a take-up motor 30. Activation of the take-up motor 30 may rotate the take-up support 26, which may in turn wind the tobacco paper 28 onto the take-up support 26. At the same time, the supply support 24 may be driven by a supply motor 32. The supply motor 32 may rotate in an opposite direction from the take-up motor 30. In addition, the amount of power provided to the supply motor 32 may be substantially less than the amount of power delivered to the take-up motor 30. The effect of this configuration may be to add back tension to the tobacco paper 28 so that the vaporization of the tobacco from the tobacco paper 28 may be more consistent. It should be understood that the power delivered to the supply motor 32 should be low enough so that the supply support 24 is allowed to rotate in the same direction as the take-up support 26 and so that the back tension in the tobacco paper 28 is not enough to tear the tobacco paper 28. Alternatively, it is contemplated that the supply motor 32 may be omitted or that the supply motor 32 may operate in the same direction as the take-up motor 30.

The drive assembly 18 may include a driving wheel 34 and a driving motor 36. The driving wheel 34 may control the speed at which the tobacco paper 28 moves across the heater 20. In operation, the driving motor 36 may actuate the driving wheel 34. Once the driving wheel 34 is actuated, the driving wheel 34 may pull an unrolled portion of the tobacco paper 28 across the heater 20 at a predetermined speed. The driving wheel 34 may be pressed against the heater 20 so that frictional forces may catch and pull the tobacco paper 28. It contemplated that the driving wheel 34 may have a textured surface (e.g., knurled, dimpled, sandblasted, etc.) or may be made of a high friction material such as rubber in order to increase the frictional force applied to the tobacco paper 28, which can increase the ability of the driving wheel 34 to pull the tobacco paper 28 across the heater 20.

It is contemplated that the take-up motor 30, the supply motor 32, and the driving motor 36 may be actuated simultaneously by way of the same input source 38. For example, the housing 12 may include a button, switch, pressure sensor, or other type of user input device. To actuate the take-up motor 30, the supply motor 32, and the driving motor 36, the user may press, touch or move the input source 38. Signals from the input source 38 may be transmitted to the take-up motor 30, the supply motor 32, and the driving motor 36 so that the take-up motor 30, the supply motor 32, and the driving motor 36 are active as long as the user engages the input source 38. Alternatively, the take-up motor 30, the supply motor 32, and the driving motor 36 may be active for a predetermine amount of time (e.g., 3 to 5 seconds) after the input source 38 is engaged. It is also contemplated that the take-up motor 30, the supply motor 32, and the driving motor 36 may be activated by a change in pressure or change of gas flow within the housing 12 caused by the user's inhalation. The user's inhalation may be detected by a flow sensor or a pressure sensor (not shown).

The heater 20 may be positioned between the tobacco paper 28 and the fluid container 22. A leading edge of the heater 20 may be in the form of a guide vane 40, which may guide the tobacco paper 28 along its path and/or contribute to the back tension applied to the tobacco paper 28. As previously discussed, the back tension in the tobacco paper 28 may help make the vaporization of the tobacco from the tobacco paper 28 more consistent. Due to the back tension in the tobacco paper 28, the tobacco paper 28 may be biased against the heater 20, thereby making the interface between the tobacco paper 28 and the heater 20 more consistent.

It is contemplated that a power supply (or battery) 42 may provide power to the heater 20. The power supply 42 may also provide power to the take-up motor 30, the supply motor 32, and the driving motor 36. In addition, the heater 20 may be actuated by the same input source 38 (or user inhalation) as the take-up motor 30, the supply motor 32, and the driving motor 36 so that the heater 20 is actuated only when the tobacco paper 28 is advanced. This may prevent the heater 20 from heating portions of the tobacco paper 28 that already been used, thereby making the quality of the vapor generated by the heater more consistent. The amount of heat generated by the heater 20 may be limited to a temperature below the combustion temperature of the tobacco paper 28 in order to prevent or minimize the generation of carcinogenic particles that may be produced by way of combustion. For example, the heater 20 may be configured to generate a temperature between 50° C. and 650° C. or between 450° C. and 500° C.

The fluid container 22 may store a liquid infused with flavor, nicotine, and/or other chemical. The fluid container 22 may include a storage portion 44, a heating portion 46, and a discharge portion 48. The storage portion 44 may include a reservoir for the liquid. The housing 12 may include a sealable opening (not shown) that may allow the storage portion 44 to be filled with the liquid. The capacity of the storage portion 44 may be large enough so that the all of the useful portions of the tobacco paper 28 is subjected to vaporization before (or at the same time as) all of the liquid is expelled from the storage portion 44.

The heating portion 46 may be in the form of a coil heater, a flat heater, or any other type of heater that is compact and is capable of discharging enough heat energy to vaporize the liquid. A metered portion of the liquid may be released from the storage portion 44 to the heating portion 46 and then vaporized. The generated vapor may then be discharged from the fluid container 22 by way of the discharge portion 48. Once discharged from the fluid container 22, the vapor may mix with the tobacco infused vapor generated by the heater 20 and then discharged from the housing 12 of the heat-not-burn cartridge 10 by way of the mouthpiece 14.

It is contemplated that the housing 12 may include a make-up vent 50 with a check valve (not shown). The make-up vent 50 may help facilitate the user's ability to draw the vapor through the mouthpiece 14 by allowing outside air to back fill the housing 12. The back filling of the housing 12 may prevent the pressure inside the housing 12 from falling below a threshold pressure. Alternatively, the housing 12 may omit the make-up vent 50 and the make-up air may enter the housing 12 through the mouthpiece 14 in between user inhalations.

Figure 2:
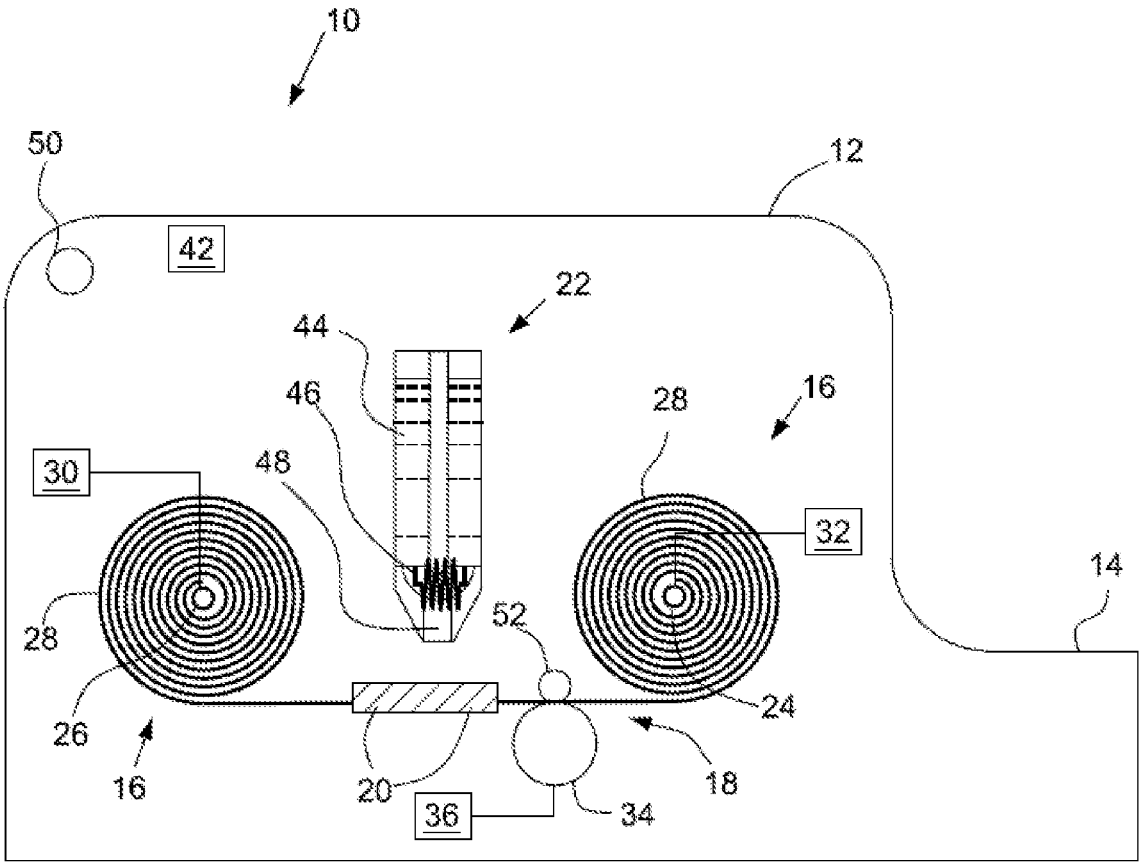
FIG. 2 is a plan view of another exemplary heat-not-burn tobacco paper cartridge.

FIG. 2 illustrates the heat-not-burn cartridge 10 with a different drive assembly 18 and a different heater 20. In FIG. 20, the driving wheel 34 may be located upstream of the heater 20. In addition, instead of biasing the tobacco paper 28 directly against the heater 20 (as is the case in FIG. 1), the driving wheel 34 may bias the tobacco paper 28 against a follower wheel 52. In the illustrated configuration, the driving wheel 34 may press against the follower wheel 52 to pull the tobacco paper 28 at a consistent speed. Similar to the configuration in FIG. 1, the driving wheel 34 may use frictional forces to catch and pull the tobacco paper 28.

It is contemplated that the follower wheel 52 in combination with the driving wheel 34 may provide enough tension in the tobacco paper 28 to eliminate the need for an additional tension adding device. Thus, the heater 20 of FIG. 2 may lack a guide vane. In addition, the heater 20 of FIG. 2 may heat one or both sides of the tobacco paper 28. It is contemplated that the tobacco paper 28 may be fed across an outer surface of the heater 20 or may be fed through an orifice that extends the length of the heater 20.

Figure 3:
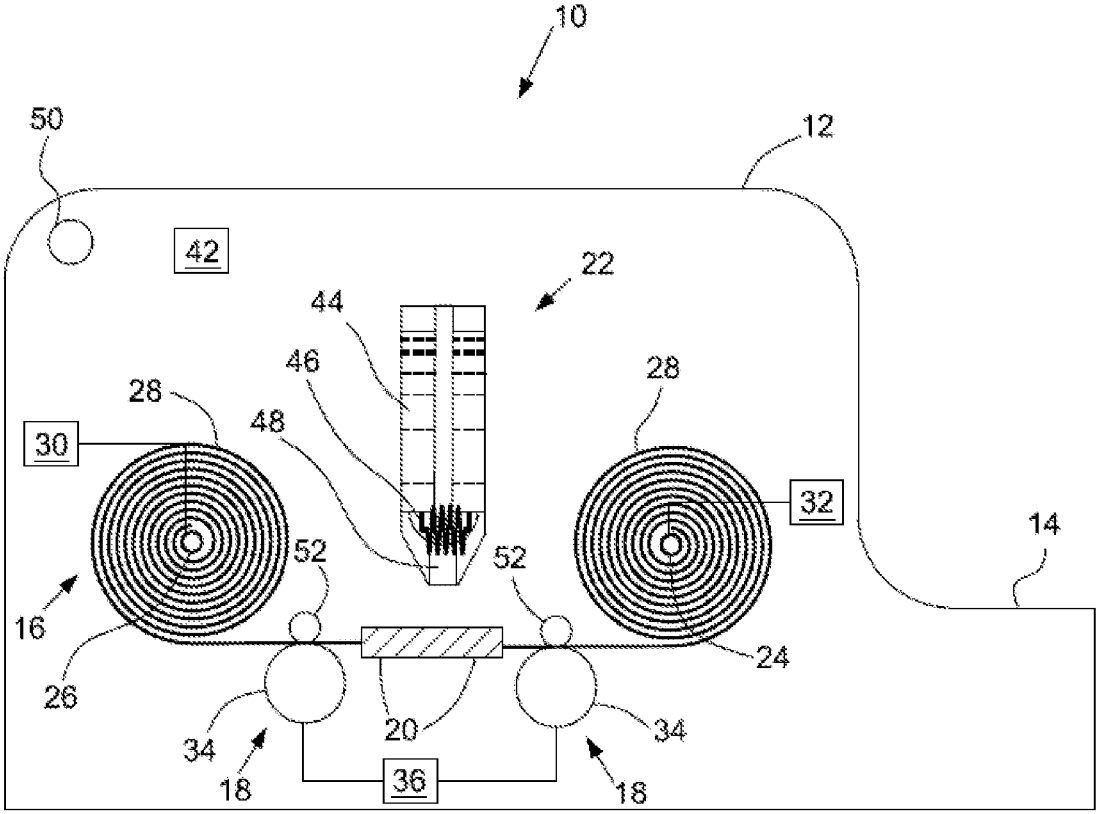
FIG. 3 is a plan view of another exemplary heat-not-burn tobacco paper cartridge.

FIG. 3 illustrates a configuration in which the drive assembly 18 includes two driving wheels 34 and two follower wheels 52. A first set of driving wheel 34 and follower wheel 52 may be positioned upstream of the heater 20, while a second set of driving wheel 34 and follower wheel 52 may be positioned downstream of the heater 20. Both sets of driving wheel 34 and follower wheel 52 may be driven by the same driving motor 36. The downstream driving wheel 34 and follower wheel 52 may be an additional source of tension that may make the heating of the tobacco paper 28 more consistent.

Figure 4:
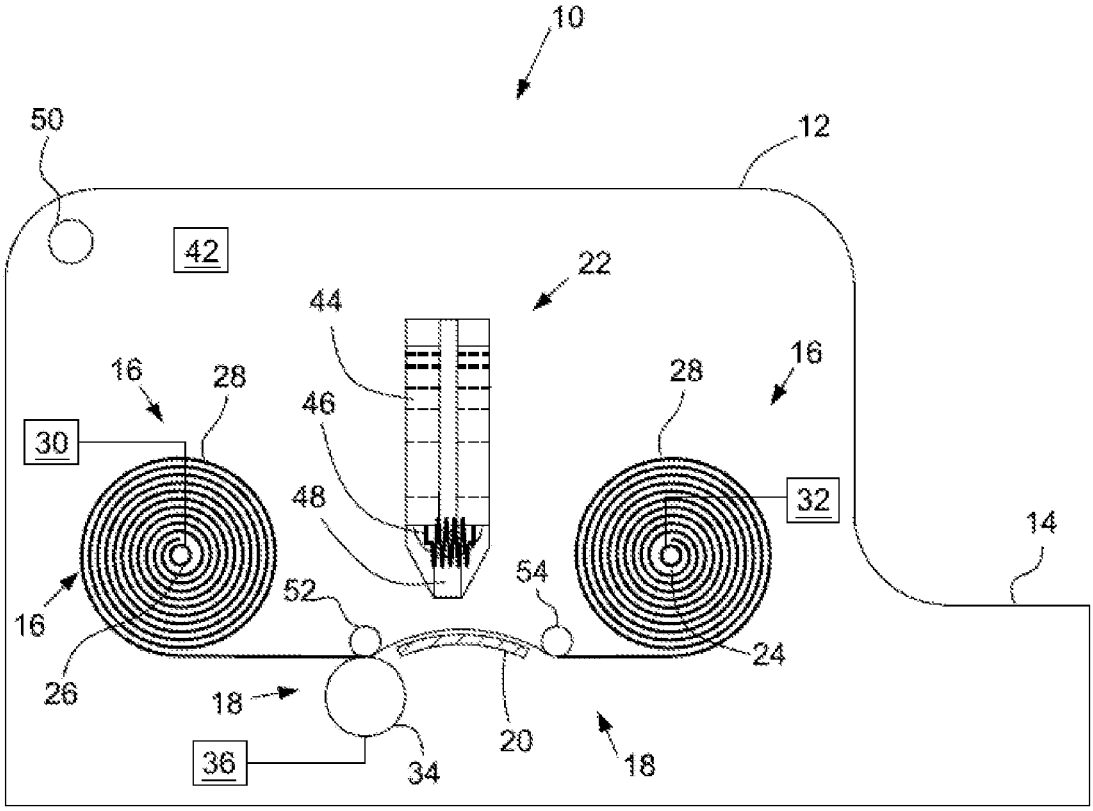
FIG. 4 is a plan view of another exemplary heat-not-burn tobacco paper cartridge.

FIG. 4 illustrates a configuration in which the driving wheel 34 and the follower wheel 52 may be located downstream of the heater 20. A guide pillar 54 may be located upstream of the heater 20. The guide pillar 54 may have a similar function as the guide vane 40 illustrated in FIG. 1. In particular, the guide pillar 54 may guide the tobacco paper 28 along its path and/or contribute to the back tension applied to the tobacco paper 28.

In addition, the heater 20 may have an arcuate shape so that the tobacco paper moves across a convex side of the heater 20. This may allow for a larger contact surface between the tobacco paper 28 and the heater 20, which may allow for a more consistent heating of the tobacco paper. Also, the convex shape may avoid inconsistent tension in the tobacco paper 28, which may reduce the likelihood of the tobacco paper 28 from tearing.

Figure 5:
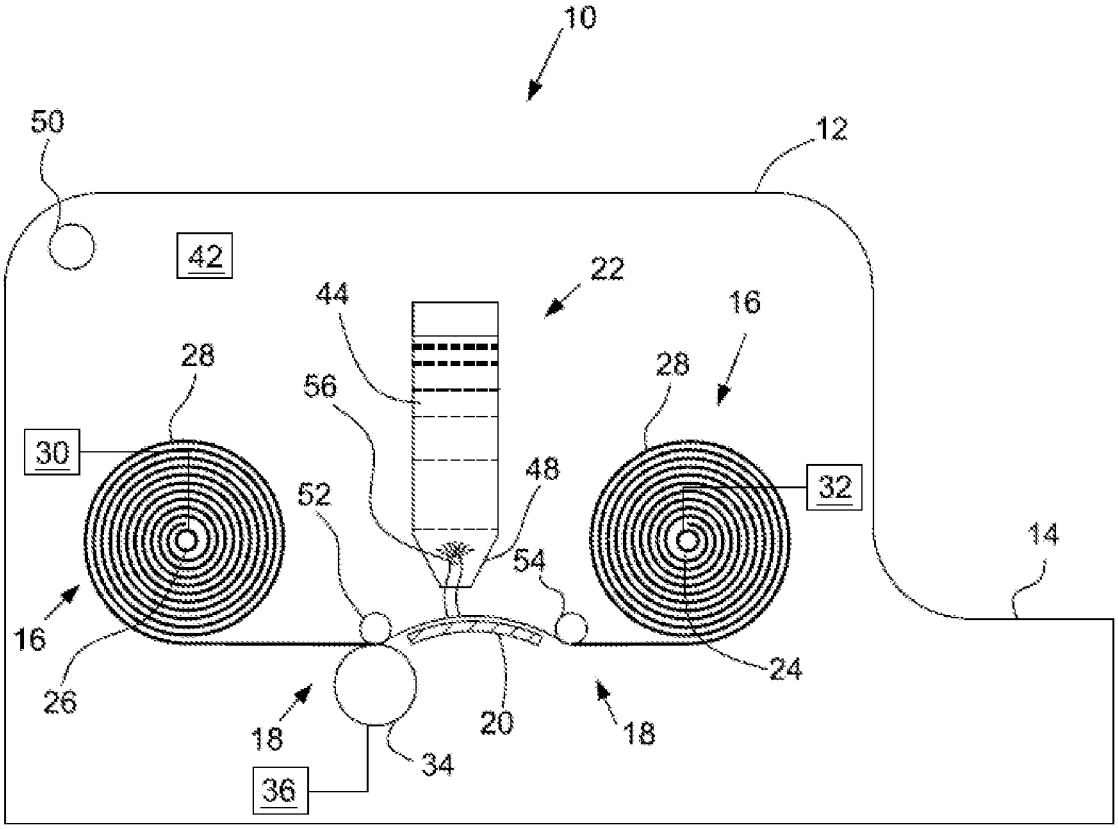
FIG. 5 is a plan view of another exemplary heat-not-burn tobacco paper cartridge.

FIG. 5 illustrates a configuration in which the heating portion 46 of the fluid container 22 is omitted. Instead, a wick 56 may be positioned within the discharge portion 48 of the fluid container 22. Liquid within the storage portion 44 may be drawn out through the wick 56 and toward the heater 20. The wick 56 may be close enough to the heater 20 so that the heater simultaneously vaporizes the liquid in the wick 56 and the tobacco in the tobacco paper 28.

All of the configurations illustrated thus far have been self-contained devices that can be used independently of any other apparatus. However, it is contemplated that the heat-not-burn cartridge 10 may be a disposable part of a larger device.

Figure 6:
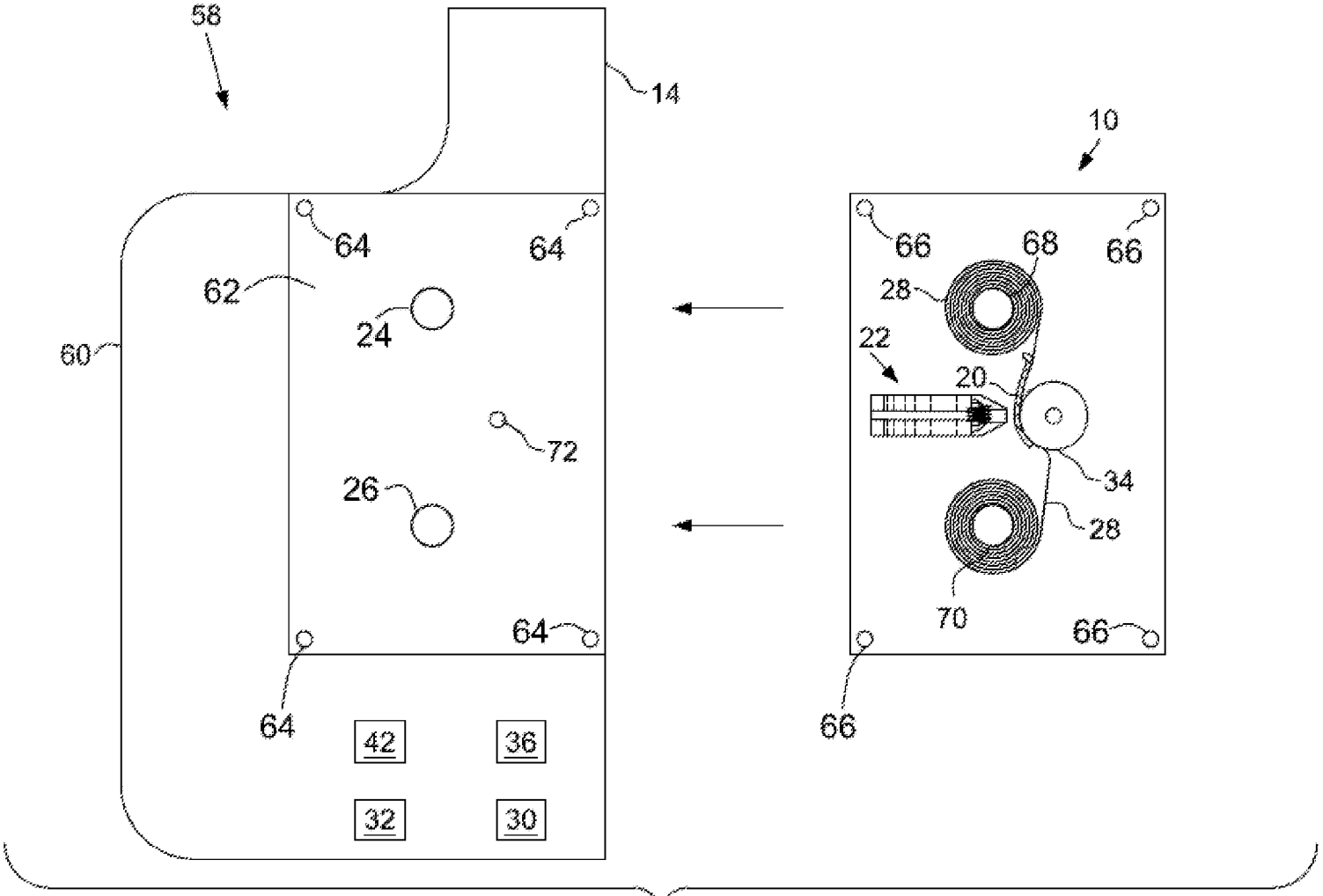
FIG. 6 is a plan view of an exemplary heat-not-burn tobacco paper system with a base and a cartridge.

FIG. 6 illustrates a heat-not-burn system 58, which includes a base 60 and the heat-not-burn cartridge 10. The base 60 may include the supply support 24, the take-up support 26, the take-up motor 30, the supply motor 32, the driving motor 36, and the power supply 42. A receiving portion 62 may receive the heat-not-burn cartridge 10 and may include securing pins 64 to secure the heat-not-burn cartridge 10 to the base 60. The securing pins 64 may engage openings 66 that extend all the way through the housing 12 so that the interior of the housing 12 remains sealed.

The heat-not-burn cartridge 10 may also include a supply spindle 68 configured to be driven by the supply support 24. A take-up spindle 70 in the heat-not-burn cartridge 10 may be configured to be driven by the supply support 24.

The base may include a driving rod 72 that may engage the driving wheel 34 when the heat-not-burn cartridge 10 is attached to the base 60. The driving rod 72 may be inserted into an opening (not shown) in the driving wheel 34, which may in turn actuate the driving wheel 34.

The base 60 may also include the mouthpiece 14, which may be permanently attached to the base 60 or may interchangeable with other mouthpieces 14.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A heat-not-burn tobacco paper cartridge comprising:

a first rotatable support;

a second rotatable support, the first and second rotatable supports being configured to transfer a strip of tobacco paper from the first rotatable support to the second rotatable support;

a heating arrangement comprising a first heater positioned between the first and second rotatable supports, the first heater being configured to heat a portion of the strip of tobacco paper extending between the first and second rotatable supports; and a fluid container configured to store chemically infused liquid, wherein the heating arrangement is configured to vaporize the chemically infused liquid.

2. The cartridge of claim 1, wherein the first heater is configured to heat the portion of the strip of tobacco paper without combusting the tobacco paper.

3. The cartridge of claim 1, wherein the first heater is configured to vaporize tobacco from the portion of the strip of tobacco paper without combusting the tobacco paper.

4. The cartridge of claim 1, further comprising a casing that encloses the first rotatable support, the second rotatable support, the strip of tobacco paper, and the heating arrangement.

5. The cartridge of claim 1, further comprising a driving wheel positioned adjacent the first heater, the driving wheel being configured to pull the tobacco paper across the first heater.

6. The cartridge of claim 1, further comprising a guide vane configured to guide the strip of tobacco paper along a path from the first rotatable support to the second rotatable support.

7. The cartridge of claim 1, wherein the heating arrangement further comprises a second heater in the fluid container.

8. The cartridge of claim 7, wherein the fluid container is adjacent the first heater.

9. The cartridge of claim 8, wherein the first heater is configured to vaporize tobacco from the tobacco paper, and wherein the vaporized tobacco is configured to mix with the vaporized fluid from the fluid container.

10. The cartridge of claim 1, wherein a wick extends from the fluid container to the first heater.

11. The cartridge of claim 10, wherein the wick is configured to draw the liquid from the fluid container to the first heater.

12. The cartridge of claim 11, wherein the first heater is configured to simultaneously vaporize liquid in the wick and tobacco in the tobacco paper.

13. The cartridge of claim 1, further comprising a mouthpiece.

14. A heat-not-burn system comprising:

the cartridge of claim 1; and a base configured to releasably receive the cartridge.

15. A heat-not-burn tobacco paper cartridge comprising:

a first rotatable support configured to support a roll of tobacco paper;

a second rotatable support configured to receive the tobacco paper from the first rotatable support;

a heating arrangement comprising a first heater between the first and second rotatable supports, and configured to vaporize tobacco in an unrolled portion of the tobacco paper extending between the first and second rotatable supports; and a fluid container configured to store chemically infused liquid, wherein the heating arrangement is configured to vaporize the chemically infused liquid.

16. The cartridge of claim 15, further comprising a switch, button, or pressure sensor configured to actuate the heating arrangement.

17. The cartridge of claim 15, wherein the heating arrangement is configured to actuate by a user inhaling vapor formed in the cartridge.

18. The cartridge of claim 15, further comprising a driving wheel configured to intermittently pull the tobacco paper across a surface of the first heater.

19. The cartridge of claim 18, wherein the driving wheel is configured to press the tobacco paper against the surface of the first heater.

20. The cartridge of claim 18, wherein the driving wheel is positioned upstream of the first heater, and the tobacco paper is sandwiched between the driving wheel and a follower wheel.

21. The cartridge of claim 18, wherein the driving wheel is positioned downstream of the first heater, and the tobacco paper is sandwiched between the driving wheel and a follower wheel.

22. The cartridge of claim 15, wherein the width of the tobacco paper is 3.0 cm or less.

23. The cartridge of claim 15, wherein the length of the tobacco paper is 100 meters or less.

24. The cartridge of claim 15, further comprising a mouthpiece.

25. A heat-not-burn system comprising:

the cartridge of claim 15; and a base configured to releasably receive the cartridge.

26. The cartridge of claim 15, wherein the heating arrangement further comprises a second heater in the fluid container.

27. The cartridge of claim 26, wherein the fluid container is adjacent the first heater.

28. The cartridge of claim 27, wherein the first heater is configured to vaporize tobacco from the tobacco paper, and wherein the vaporized tobacco is configured to mix with the vaporized fluid from the fluid container.

29. A heat-not-burn tobacco paper cartridge comprising:

a first rotatable support;

a second rotatable support;

a strip of tobacco paper attached to both the first and second rotatable supports; and a heating arrangement comprising a tobacco heater configured to vaporize tobacco from the tobacco paper without combusting the tobacco or the tobacco paper; and a fluid container configured to store chemically infused liquid, wherein the strip of tobacco paper is configured to be transported through an interior of the tobacco heater in response to user input, and wherein the heating arrangement is configured to vaporize the chemically infused liquid.

30. The cartridge of claim 29, further comprising a casing that encloses the first rotatable support, the second rotatable support, the tobacco paper, and the tobacco heater.

31. The cartridge of claim 30, wherein the casing includes a make-up vent.

32. The cartridge of claim 29, further comprising a first driving wheel and a second driving wheel, each of the first and second driving wheels being configured to pull the tobacco paper through the tobacco heater.

33. The cartridge of claim 32, wherein the first driving wheel is located upstream of the tobacco heater, and the second driving wheel is located downstream of the tobacco heater.

34. The cartridge of claim 29, further comprising a user input source configured to actuate movement of the tobacco paper from the first rotational support to the second rotational support.

35. The cartridge of claim 34, wherein the user input source is a button, a switch, and/or a pressure sensor.

36. The cartridge of claim 34, wherein the user input source is a flow sensor and/or a pressure sensor configured to detect a user's inhalation.

37. The cartridge of claim 29, further comprising a mouthpiece.

38. A heat-not-burn system comprising:

the cartridge of claim 29; and a base configured to releasably receive the cartridge.

39. The cartridge of claim 29, wherein the heating arrangement further comprises a fluid heater in the fluid container, the fluid heater being configured to heat and vaporize the fluid contained in the fluid container.

40. The cartridge of claim 39, wherein the fluid container is adjacent the tobacco heater.

41. The cartridge of claim 40, wherein the tobacco heater is configured to vaporize tobacco from the tobacco paper, and wherein the vaporized tobacco is configured to mix with the vaporized fluid from the fluid container.

* * * * *